US008202106B2

(12) United States Patent
Marklove et al.

(10) Patent No.: US 8,202,106 B2
(45) Date of Patent: Jun. 19, 2012

(54) SUBMERSIBLE ELECTRICAL CONNECTOR

(75) Inventors: Michael Christopher Marklove, Dalton (GB); John Rogers, Ulverston (GB); Jonathan Hardisty, Ulverston (GB)

(73) Assignee: Tronic Limited, Cumbria (GB)

( * ) Notice: Subject to any disclaimer, the term of this patent is extended or adjusted under 35 U.S.C. 154(b) by 0 days.

(21) Appl. No.: 13/329,840

(22) Filed: Dec. 19, 2011

(65) Prior Publication Data

US 2012/0088385 A1 Apr. 12, 2012

Related U.S. Application Data

(63) Continuation of application No. 12/683,884, filed on Jan. 7, 2010, now Pat. No. 8,079,862, which is a continuation of application No. 12/150,630, filed on Apr. 30, 2008, now Pat. No. 7,794,254.

(60) Provisional application No. 60/926,922, filed on Apr. 30, 2007.

(51) Int. Cl.
*H01R 13/52* (2006.01)

(52) U.S. Cl. ..... 439/271

(58) Field of Classification Search ..... 439/604, 439/587, 201, 206, 205, 199, 273, 276, 271
See application file for complete search history.

(56) References Cited

U.S. PATENT DOCUMENTS

| | | | |
|---|---|---|---|
| 3,085,138 | A | 4/1963 | Brown et al. |
| 4,753,604 | A | 6/1988 | Wheeler |
| 5,174,765 | A | 12/1992 | Williams et al. |
| 7,534,147 | B2 | 5/2009 | Marklove et al. |
| 2005/0202720 | A1 | 9/2005 | Burke et al. |

FOREIGN PATENT DOCUMENTS

| | | | |
|---|---|---|---|
| EP | 1209772 | | 5/2002 |
| GB | 1537061 | A | 12/1978 |
| GB | 2192316 | | 1/1988 |
| GB | 2264201 | | 8/1993 |
| GB | 2330702 | | 4/1999 |
| GB | 2361365 | | 10/2001 |
| GB | 2420919 | | 6/2006 |
| GB | 2429587 | | 2/2007 |
| GB | 2440183 | | 1/2008 |
| WO | WO8400078 | A1 | 1/1984 |
| WO | WO9845900 | | 10/1998 |

OTHER PUBLICATIONS

Extended European Search Report for European Application No. EP 08 25 1586, Completed at the Hague on Sep. 25, 2009.

*Primary Examiner* — Vanessa Girardi
(74) *Attorney, Agent, or Firm* — Alix, Yale & Ristas, LLP

(57) ABSTRACT

A connector for use underwater or in a wet or severe environment comprises first and second connector parts adapted to be interengaged to establish an electrical connection. The first connector part has at least one pin, and the second connector part has at least one electrical contact for engagement by the pin when the connector parts are interengaged. The pin comprises an axially extending electrically conductive portion and an axially extending electrically insulating sleeve around said conductive portion, and the pin is supported by and projects axially forwardly from a support whereby its insulating sleeve is exposed along a longitudinally extending portion thereof to ambient conditions when the connector parts are disengaged. The connector part has a protective rigid metal sleeve member arranged to extend at least partly along the first portion of the insulating sleeve and at least partly along the second portion thereof.

5 Claims, 6 Drawing Sheets

1
4
6
8
10
12
14
16
18
20
21
22
24
25
26
27
28
30

SUBMERSIBLE ELECTRICAL CONNECTOR

CROSS-REFERENCE TO RELATED APPLICATION

This application is a continuation of U.S. patent application Ser. No. 12/683,884, filed Jan. 7, 2010, now U.S. Pat. No. 8,079,862 which is a continuation of U.S. patent application Ser. No. 12/150,630, filed Apr. 30, 2008, now U.S. Pat. No. 7,794,254, which claims the benefit of U.S. Provisional Application No. 60/926,922 filed Apr. 30, 2007.

BACKGROUND

The present invention relates to an electrical connector for use underwater or in a wet or severe environment comprising first and second connector parts adapted to be interengaged to establish an electrical connection. It also relates to a connector part for such a connector.

Electrical connectors for use underwater are known, for example from United Kingdom patent application No. GB-A-2,192,316, to have first and second connector parts in which the first connector part has at least one pin projecting from a support which is inserted into a housing and fixed in place by a retainer ring. The pin has an axially extending conductive copper core surrounded by an insulating sleeve which is arranged to expose an area of the conductive core at or near the tip of the pin for making electrical contact with a contact socket in the second connector part.

The housing extends in an axial direction from the support, radially outwardly of the contact pins, for alignment with and to receive the housing of the second connector part during interengagement. This extended housing of the first connector part defines a pin chamber in which the pins extend.

In the de-mated condition this pin chamber is exposed to the external environment and flooded with, for example, sea water. The insulating sleeve is intended to insulate the conductive core of the pin from exposure to the external environment.

GB-A-2,192,316 discloses an embodiment of a connector having a wiper member provided on a resiliently biased piston for removing contaminants from the outer surface of the pin prior to the entry of the pin into sealed chambers of the second connector part. During connection, the wiper is pushed rearwardly along the pin by the other connector half as it advances. The pin chamber defined by the first connector housing behind the piston reduces in volume during this process. The chamber is connected to the external environment, or "free flooded", in order to allow the change in volume.

GB-A-2,264,201 discloses an underwater electrical connector having a plurality of pins extending from and supported by a pin carrier and having a pin carrier seal provided at the face of the pin carrier, adjacent to the pins. The contact areas of the pins are electrically isolated from the external environment at all times by way of a slidable and resiliently biased dielectric seal carrier disposed on the pins. The dielectric seal carrier contains an insulating dielectric fluid sealed in a carrier cavity by forward and rearward annular O-ring seals disposed between the pins and the carrier body. The pin chamber, defined by the volume inside the housing behind the dielectric seal carrier and in front of the pin carrier is open to the external environment of seawater, i.e. it is free flooded.

During interengagement with the second connector part, the dielectric seal carrier is pushed rearwardly along the pins compressing the resiliently biased helical spring. The seawater trapped in the pin chamber is allowed to escape to the external environment by a vent hole as the volume of the pin chamber is reduced. When fully mated, a pin protector inner overseal on the rear of the dielectric seal carrier and the pin carrier seal are arranged such that they are energised to expel any seawater from between their joining faces. The purpose of the pin carrier seal is to seal the pin against the outside environment when the connector parts are fully mated.

GB-A-2,330,702 discloses an underwater electrical connector part having a resiliently biased, axially movable shuttle provided between the pins and the housing. The pins are retained in a chamber defined by a membrane containing insulating fluid. In this case, therefore, the pin chamber is not free flooded. The membrane is connected to the axially rearward face of the shuttle and the axially forward face of the pin support and double O-ring seals are provided between the shuttle and the pins to seal the chamber from the external environment. The connector part is flooded with seawater from the external environment radially outwardly of the membrane. The membrane is of a suitable material to allow for pressure balancing in the pin chamber when the shuttle is moved rearwardly against the resilient bias of a helical spring during interengagement of the connectors.

The sealed chamber and shuttle arrangement provides a seal for the base of the pins at all times. However, the movable shuttle and membrane arrangement is a complicated arrangement which provides protection from the external environment to the whole of the length of the pin. This may make the apparatus more prone to failure due to the large number of moving parts and the moving seals.

US-A-2005/0202720 discloses a hermetic pressure connector for providing an electrically conductive connection through a hole in a bulkhead, the connector having a high pressure side and a low pressure side defined by a transverse support member through which extends a plurality of pins supported on a molded connector body. The transverse support member may be made of metal and is provided as a block arranged to seat against a pressure bearing ledge of the bulkhead and abut the bulkhead at its outer diameter. The pins have an insulating sleeve and the molded connector body sealingly engages the transverse support member, the connector pins and the insulating sleeves. The transverse support member offers mechanical support to each of the pins where they protrude from the molded connector body.

GB-A-2,361,365 discloses a high voltage electrical connector comprising a first connector part having pins which are arranged to, during interengagement, pass through a seal of a second connector part into a sealed chamber to make an electrical connection therein. The pins have an axially extending conductive core surrounded by an axially extending insulating portion. When an electrical connection is made and current is flowing, the electrical field gradient can become high in the area proximal to the conductive core such that the equipotential electrical field lines are condensed in the region of the seal of the second connector due to the earthing effect of sea water. This high electrical field gradient subjects the seal to high electrical field stress which, after prolonged use, can lead to degradation and failure of the seal, leakage into the sealed chamber and damage to the second connector part. To reduce this, a screening conductive layer electrode is embedded in the pin arranged to screen the seal of the second chamber from a concentration of equipotential electrical field lines in the mated condition. This embedded screening electrode leads to a connector pin structure which may be difficult to mold.

An alternative known arrangement is to provide a metal screening sleeve embedded in the pin at the pin base and the insulative layer of the pin being formed to have a recess in which the metal screening sleeve is seated so that its outer surface is flush with the outer surface of the insulative layer of the pin forwardly of the sleeve. This structure requires careful molding of the pin.

SUMMARY

Viewed from a first aspect, a connector for use underwater or in a wet or severe environment comprises first and second connector parts adapted to be interengaged to establish an electrical connection, the first connector part having at least one pin, and the second connector part having at least one electrical contact for engagement by the pin when the connector parts are interengaged, the pin comprising an axially extending electrically conductive portion and an axially extending electrically insulating sleeve around said conductive portion, and the pin being supported by and projecting axially forwardly from a support whereby its insulating sleeve is exposed along a longitudinally extending portion thereof to ambient conditions when the connector parts are disengaged, wherein the insulating sleeve of the pin has a first portion with a first diameter in front of a second portion with a second diameter wider than the first diameter, and the connector part having a protective rigid metal sleeve member arranged to extend at least partly along the first portion of the insulating sleeve and at least partly along the second portion thereof, the rigid metal sleeve providing mechanical support to the protected portion of the pin.

Known connector pins may be subject to mechanical stress, particularly at the base area of the connector pin proximal to where the pin projects axially from the support. The stress may result from bending moments exerted on the pin where it projects from the support during mating of the connector parts, for example if there is any misalignment. The stress may also result from residual bending stresses due to the moulding process and the manufacturing techniques by which the pin itself is formed.

In known connectors, these stresses may result in cracking at the base of the pin leading to failure of the connector when the conductor core of the pin is exposed to the external environment of sea water. Thus this cracking may substantially shorten the operational life of the connector.

The pin is provided with an insulating sleeve having a first portion with a first diameter in front of a second portion with a second diameter wider than the first diameter, and the connector part having a protective rigid metal sleeve member arranged to extend at least partly along the first portion of the insulating sleeve and at least partly along the second portion thereof, gives a pin shape which provides mechanical support to the protected portion such that any tendency for cracking of the pin due to high stress in that area is reduced. It also reinforces the protected portion of the pin and strengthens it against bending stresses acting on the pin or may offer support against the bending stresses acting on the pin by way of reactionary forces, such that the stresses will not result in the cracking of the pin. This arrangement can therefore prevent the exposure of the electrically conductive portion to the ambient environment. This extends the operational lifetime of the connector and reduces the maintenance costs of the user.

This arrangement also reduces the localised condensing of equipotential electrical field lines in the region radially outwardly and behind the front of the rigid metal sleeve thus reducing electrical stress on any material in those screened regions.

The rigid metal sleeve preferably follows the longitudinal profile of the insulating sleeve. Thus, in embodiments where the insulating sleeve has a longitudinal profile of varying diameter, the rigid metal sleeve may also have a corresponding longitudinal profile. For example, the rigid metal sleeve may have a conical section corresponding to a conical section of the insulating sleeve.

In some embodiments, the pin may have the second wider diameter portion where it is carried by the support and the narrower diameter portion extending forwardly from the support. This can improve the strength of the pin against any bending or shock loads. In certain embodiments, the protected portion of the insulating sleeve may comprise a conically shaped section adjacent to the support and an axially cylindrical section extending forwardly from the conical section.

Preferably, the second portion of the insulating sleeve having the second diameter is substantially cylindrical, i.e. the second diameter is constant over the axial length of the cylinder.

In this preferred arrangement, the axial cylindrical extent of the insulating sleeve portion of the pin along which the rigid metal sleeve at least partly extends offers high rigidity and mechanical support to the protected portion of the pin and suppresses cracking.

Preferably the metal sleeve member extends in the support and projects forwardly therefrom.

Viewed from a second aspect, a connector for use underwater or in a wet or severe environment, comprises first and second connector parts adapted to be interengaged to establish an electrical connection, the first connector part having at least one pin, and the second connector part having at least one electrical contact for engagement by the pin when the connector parts are interengaged, the pin comprising an axially extending electrically conductive portion and an axially extending electrically insulating sleeve around said conductive portion, and the pin being supported by and projecting axially forwardly from a support whereby its insulating sleeve is exposed along a longitudinally extending portion thereof to ambient conditions when the connector parts are disengaged, and the first connector part having a protective rigid metal sleeve arranged to protect a portion of the insulating sleeve forwardly of and adjacent to the support at least when the connector parts are disengaged, the rigid metal sleeve surrounding the insulating sleeve of that pin only, the rigid metal sleeve extending in and abutting against the support and extending along at least part of the protected portion of the pin forwardly of the support, whereby the rigid metal sleeve provides mechanical support to the protected portion of the pin, and wherein the external diameter of the insulating sleeve in at least the foremost region of the protected portion of the pin is greater than or equal to the external diameter of the insulating sleeve in the region immediately forward of the protected portion of the pin.

According to this aspect, the manufacturing process for preparing the pin and the metal sleeve is simplified by providing the metal sleeve as a metal sleeve for the pin which provides a high level of protection. The rigid metal sleeve provides mechanical support to that pin by extending in and abutting against the support and also extending along the protected portion of the pin. In this arrangement the individual rigid metal sleeve offers high suppression of bending and cracking in the protected portion of that pin forwardly of the support due to the abutment of the rigid metal sleeve against the support but has a simple construction.

In preferred embodiments where plural pins are provided, each pin is preferably provided with a respective rigid metal sleeve.

The manufacturing process for the pin is simplified because no recess in the surface of insulating sleeve is required as a seat for the rigid metal sleeve. Instead the rigid metal sleeve is seated on the outer surface of the insulating sleeve which has a diameter that does not decrease in the protected portion of the pin, and therefore the pin can be simply manufactured with no complicated moulding required. The rigid metal sleeve can for example be put in position by merely sliding it over the pin.

Further, the pin and rigid metal sleeve of the invention can be manufactured separately having an appropriate shape to fit into the support bore and they can then be inserted into the support individually. Further, should any pin or rigid metal sleeve fail and require replacement, that pin and rigid support sleeve can be removed and replaced individually. No elaborate or complicated arrangement of a rigid support block that matches the shape of the housing and all of the pins in the connector is needed to provide mechanical support. Such an elaborate arrangement requires complicated dismantling of the connector and removal of the pins and the rigid metal support block should any of the pins or the rigid metal support block fail and require replacement.

The rigid metal sleeve is preferably provided on and protrudes radially from the surface of the insulating sleeve and so does not have an outer surface which is flush with the outer surface of the insulating sleeve.

There is preferably no relative movement between the protective member and the pin. The protective member is preferably not provided in a sliding seal arrangement. Thus in this arrangement, the protective member engages the same part of the pin irrespective of whether the connector parts are interengaged or disengaged.

The protected portion of the insulating sleeve preferably comprises a conically shaped section adjacent to the support and an axially cylindrical section extending forwardly from the conical section.

The rigid metal sleeve provides mechanical support to the protected portion of the insulating sleeve. The protected portion may also be protected by resilient sealing means engaging the pin to prevent exposure of said protected area to ambient conditions. In this arrangement, further to having mechanical support to prevent cracking, the protected portion of the pin is also provided with a resilient seal to prevent exposure to the ambient environment such that, even if, despite the mechanical support, the protected portion of the pin is subject to cracking, the failure of the connector can be prevented. The resilient seal may for example be one or more O-rings sealing between the metal sleeve and the support.

Viewed from a third aspect, a connector for use underwater or in a wet or severe environment comprises first and second connector parts adapted to be interengaged to establish an electrical connection, the first connector part having at least one pin, and the second connector part having at least one electrical contact for engagement by the pin when the connector parts are interengaged, the pin comprising an axially extending electrically conductive portion and an axially extending electrically insulating sleeve around said conductive portion, and the pin being supported by and projecting axially forwardly from a support whereby its insulating sleeve is exposed along a longitudinally extending portion thereof to ambient conditions when the connector parts are disengaged, the insulating sleeve having a metal or metallised coating deposited on its surface at least along a length of the pin extending forwardly from the support, the metal or metallised coating suppressing the ingress of water to the pin and reducing localised condensing of equipotential electric field lines in the region radially outwardly and behind the front of the rigid metal sleeve.

According to this aspect, the pin provides protection from electrical field stresses on material in the region outwardly of and behind the metal coating and protection from water ingress in the area forwardly of the support by a very simple construction comprising a metallised coating layer on the surface of the pin. To achieve the electrical field suppression effect, no complicated molding of the pin is required to embed a screening electrode in the pin, and no complicated metal sleeve construction that is flush with the surface of the insulation of the pin is required. The coating may be arranged such that, when the connector parts are fully interengaged, any seals in the second connector part are screened from concentration of equipotential electrical field lines and electrical stresses.

Further, the provision of a metal or metallised coating on the insulating sleeve of the pin can help to suppress water ingress and reduce attack of the insulating sleeve material which prolongs the life of the connector part as well as offering an electrical field control effect.

The metallised coating may not be pure metal, for example the metallised coating may be metallic paint. Alternatively the metal coating may be pure metal.

The coating may comprise a plurality of layers, e.g. two layers. Thus there may be a base layer and a top layer. The coating may comprise a base layer of copper and a top layer of nickel.

The metal coating may comprise a base layer preferably less than 20 μm thick. Such a base layer may for example be copper. The base layer is further preferably less than 15 μm thick, even more preferably less than 12 μm thick, and more preferably still less than 10 μm thick, and even more preferably less than 5 μm thick.

The metal coating may also comprise a top layer less than 20 μm thick. Such a top layer may for example be nickel. The top layer is further preferably less than 15 μm thick, even more preferably less than 12 μm thick, and more preferably still less than 10 μm thick, and even more preferably less than 5 μm thick.

The total thickness of the coating, whether it is made up of one layer or a plurality of layers, is less than 100 μm, more preferably less than 75 μm or 50 μm or 40 μm or 30 μm or 20 μm or 10 μm. A thickness in the range of 10 μm to 30 μm, more preferably 15 μm to 25 μm is preferred.

In these arrangements, the electrical field control in the area forward of the pin is effective and the likelihood of peeling of the coating is low.

The method of depositing the metal coating on the pin preferably comprises etching the surface of the insulating sleeve to provide a key, and depositing the metal layer on the keyed surface by a suitable deposition process. Preferably, after the surface is etched an activator is applied to the surface before the coating is applied.

Viewed from a fourth aspect, a connector for use underwater or in a wet or severe environment comprises first and second connector parts adapted to be interengaged to establish an electrical connection, the first connector part having at least one pin, and the second connector part having at least one electrical contact for engagement by the pin when the connector parts are interengaged, the pin comprising an axially extending electrically conductive portion and an axially extending electrically insulating sleeve around said conductive portion, and the pin being supported by and projecting axially forwardly from a support whereby its insulating sleeve is exposed along a longitudinally extending portion thereof to ambient conditions when the connector parts are disengaged, and the first connector part having a protective member arranged to protect a portion of the insulating sleeve forwardly of and adjacent to the support at least when the connector parts are disengaged.

Protection may be provided by creating a sealed area to prevent exposure of the protected portion to of the insulating sleeve ambient conditions, or by mechanical support or reinforcement of the portion being protected. In certain embodiments, both a sealed area and mechanical support or reinforcement are provided. The invention has the advantage of protecting an area of the insulating sleeve which in known connectors may be subject to cracking.

According to this aspect of the invention, the protective member arranged to protect a portion of the insulating sleeve of the pin in the connector can prevent the exposure of the electrically conductive portion to the ambient environment, thus extending the operational lifetime of the connector and reducing the maintenance costs of the user.

The pin may have various longitudinal profiles. It may for example have a longitudinal profile in which the diameter varies along the length of the pin. In some embodiments, the pin may have a wider diameter portion where it is carried by the support and a narrower diameter portion extending forwardly from the support. This can improve the strength of the pin against any bending or shock loads. In certain embodiments, the protected portion of the insulating sleeve may comprise a conically shaped section adjacent to the support and an axially cylindrical section extending forwardly from the conical section.

The protected portion of the insulating sleeve may be protected by sealing means which engages the pin to prevent exposure of said protected portion to ambient conditions, for example resilient sealing means. In this arrangement the protected portion of the pin is sealed off from the external environment such that if cracks were to develop in the pin base due to stress in that area, the connector would not fail.

The sealing means may comprise an elastomeric membrane. The elastomeric membrane may engage the outer surface of the insulating sleeve over the full longitudinal extent of the protected portion.

The sealing means may comprise an O-ring seal, or a plurality of O-ring seals.

An insulating medium may be disposed rearwardly of the sealing means. The insulating medium may be a compliant material such as an elastomeric or polymeric material, or may be an insulating fluid such as an oil. Such materials can expand an contract with changes in temperature and pressure, so as to help maintain the integrity of the sealing means and hence that of the protected area.

The protective member may provide mechanical support to the protected portion of the insulating sleeve. The protective member may comprise a rigid metal sleeve surrounding the insulating sleeve. The protective member may comprise a rigid supporting portion connected to a housing of the first connector part. The rigid supporting portion may form an integral part of the housing of the first connector part or may be mechanically or sealingly connected to the housing of the first connector part or the support by any suitable connecting means, such as, for example, a locking ring, a screw thread, a clamping plate or a compression seal connection or may simply abut against the housing to provide mechanical support. In these arrangements, the protective member can provide sufficient mechanical support to the protected portion of the pin to prevent cracking of the pin in that area. In the embodiments in which the protective member provides mechanical support to the protected portion of the insulating sleeve, the protected portion may also be protected by resilient sealing means engaging the pin to prevent exposure of said protected area to ambient conditions.

There may be no relative movement between the protective member and the pin. The protective member is preferably not provided in a sliding seal arrangement. Thus in this arrangement, sealing means engages the same part of the pin irrespective of whether the connector parts are interengaged or disengaged.

BRIEF DESCRIPTION OF THE DRAWINGS

Certain preferred embodiments will now be described by way of example only, with reference to the accompanying drawings, in which.

DETAILED DESCRIPTION

Figures 1A, 1B:
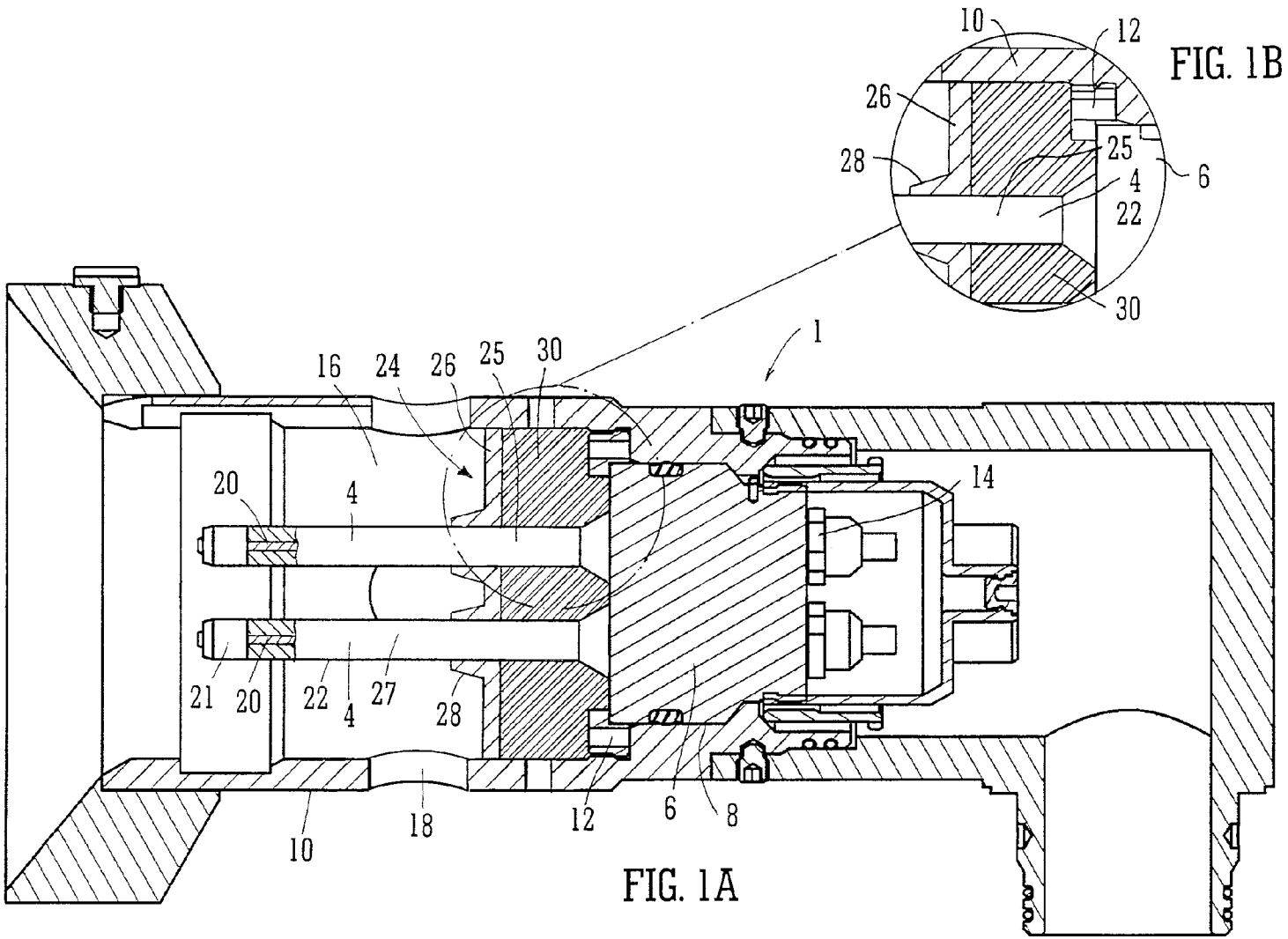
FIGS. 1A and 1B show a partly sectioned side elevation of a male part of a first embodiment of an electrical connector, with FIG. 1B representing a detail of the area circled in FIG. 1A.

FIGS. 1A and 1B show a male connector part 1 of a connector according to a first embodiment. The male connector part is suitable for interengagement with a female connector part (not shown) underwater or in a wet or severe environment. Connecting the male connector part 1 together with the female connector part makes an electrical connection.

The male connector part 1 includes at least one pin 4 supported by and extending axially forwardly from an insert 6 sealingly held in a support socket 8 of a housing 10. The insert 6 provides a support for the pin. In the various illustrated embodiments, two pins are shown. However, alternative embodiments have only one pin or more than two pins. In general, at least one pin is provided.

The insert 6 may be formed of epoxy resin or any other suitable insulating material. The insert 6 is held in place in the support socket 8 by an insert locking ring 12. Alternatively, any suitable retaining means may be employed, such as a screw thread.

The pin 4 extends inside the insert 6 and projects axially rearwardly of the insert 6. The pin is held in place in the insert 6 by a pin retaining ring 14 which abuts against the rear face of the insert 6 such that the pin 4 is securely held in position. Alternatively, any suitable means for retaining the pin in the insert 6 may be employed.

The pin 4 extends inside a receptacle 16 defined by the forwardly projecting part of the housing 10. The receptacle is "free flooded" and thus the pin is exposed to the ambient environment at least during the demated condition of the connector parts. The wall of the housing 10 is provided with at least one vent opening 18 to allow displacement of water from the receptacle as the second connector portion enters the receptacle during mating of the male and female connector parts.

The pin 4 has an axially extending conducting portion 20 (shown in partial cut-away of the pin only) surrounded by an axially extending insulating portion 22. In cross sectional profile, the pin has a conically shaped section adjacent to the insert 6 and an axially cylindrical section extending forwardly from the conical section. Alternatively, the pin may have any suitable profile. The axially extending insulating portion 22 is arranged such that near the front end of the pin a conducting ring 21, electrically connected to the axially extending conducting portion 20, is exposed to make electrical contact when mated.

During interengagement, the pin 4 enters a sealed chamber of the female connector part containing an insulating fluid medium until, in the fully mated position, the axially extending conducting portion of the pin 4 engages an electrical contact in the female connector part. At this time, the electrical connection is made and the current may be switched on. In the fully mated condition, a portion of the pin 4 surrounded by the electrically insulating sleeve may not have entered the sealed chamber of the female connector part 2 such that it remains exposed to the ambient conditions of the seawater.

A portion of the axially extending conducting portion 20 of the pin 4 surrounded by the axially extending insulating portion or sleeve 22 forwardly of and adjacent to the insert 6 is protected by protective means 24. The insulating portion 22 of the pin thus has a protected portion 25 forwardly of and adjacent to the insert 6, and an exposed portion 27 forwardly of the protected portion 25.

In this first design the protective means 24 comprises a protective member consisting of resilient sealing means in the form of an elastomeric sealing membrane 26 which engages the pin to prevent exposure of the protected portion 25 to ambient conditions. The elastomeric membrane 26 extends radially from the pin to the wall of the housing 10 to prevent any seawater from entering behind it. The elastomeric membrane 26 has a graded or wedge shaped profile 28 extending a distance axially along the outer surface of the electrically insulating sleeve 22 of the pin 4 in sealing engagement therewith. An insulating medium 30 such as a compliant insulating elastomeric or polymeric material, or an insulating fluid such as oil, is disposed rearwardly of the elastomeric membrane 26. This insulating medium 30 insulates the protected portion 25 of the pin 4 and further prevents it from exposure to ambient conditions. The compliant elastomeric membrane 26 accommodates any expansion or contraction of the insulating medium 30 due to pressure or temperature changes, while still ensuring that the protected portion 25 of the pin 4 is prevented from exposure to ambient conditions.

Thus if any cracks develop in the protected portion 25 of the pin 4 due to bending or shock stresses, the protective means 24, in the form of the resilient sealing means of the elastomeric membrane 26 and of the insulating medium 30, prevents the exposure of the protected portion 25 to ambient conditions, such as seawater, and thus the use of the connector can continue without resulting in connector failure.

Figure 2A:
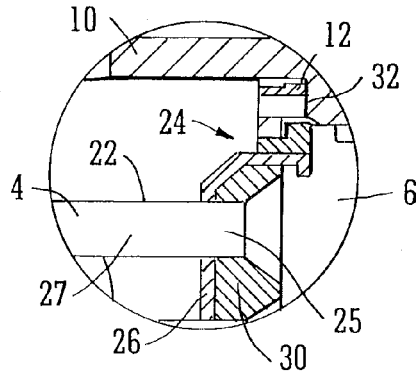
FIG. 2A shows a partly sectioned side elevation of a detail of a male part of a second embodiment of an electrical connector, FIGS. 2B and 2C showing variations of the second embodiment.

FIG. 2A shows a male connector part 1 of a connector according to a second embodiment of the present invention, which is similar to the embodiment shown in FIG. 1, but the resilient sealing means comprises an elastomeric membrane 26 extending in a radially outwardly direction from the pin 4 and axially rearwardly direction towards the insert 6. No graded or wedge shaped profile 28 is provided on the elastomeric membrane 26. A compression ring 32, held in place by the insert locking ring 12, abuts against the elastomeric membrane 26 and the insert 6 such that the elastomeric membrane 26 is sealingly engaged with the insert 6 to prevent the protected portion 25 of the pin 4 from exposure to ambient conditions. An insulating medium 30 such as a compliant insulating elastomeric or polymeric material, or an insulating fluid such as oil, is disposed rearwardly of the elastomeric membrane 26.

Figure 2B:
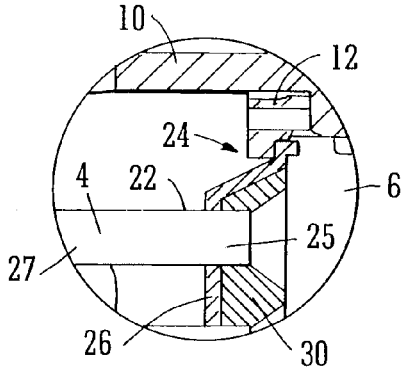

FIG. 2B shows a male connector part 1 of a connector according to a variation of the second embodiment of an electrical connector shown in FIG. 2A, in which no compression ring is provided and the elastomeric membrane 26 is held in place by being clamped at its radially outward edge between the rear face of the insert locking ring 12 and the front face of the insert 6 such that the elastomeric membrane 26 is sealingly engaged with the insert 6 to prevent the protected portion 25 of the pin 4 from exposure to ambient conditions.

Figure 2C:
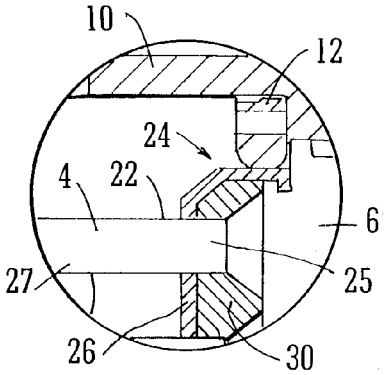

FIG. 2C shows a male connector part 1 of a connector according to another variation of the second embodiment of an electrical connector shown in FIG. 2A, in which no compression ring is provided and the radially inner face of the insert locking ring 12 abuts directly against the elastomeric membrane 26 and the insert 6 such that the elastomeric membrane 26 is sealingly engaged with the insert 6 to prevent the protected portion 25 of the pin 4 from exposure to ambient conditions.

Thus if any cracks develop in the protected portion 25 of the pin 4 due to bending or shock stresses, the protective means 24, in the form of the resilient sealing means of the elastomeric membrane 26 and of the insulating medium 30, prevents the exposure of the protected portion 25 to ambient conditions, such as seawater, and thus the use of the connector can continue without resulting in connector failure.

Figure 3:
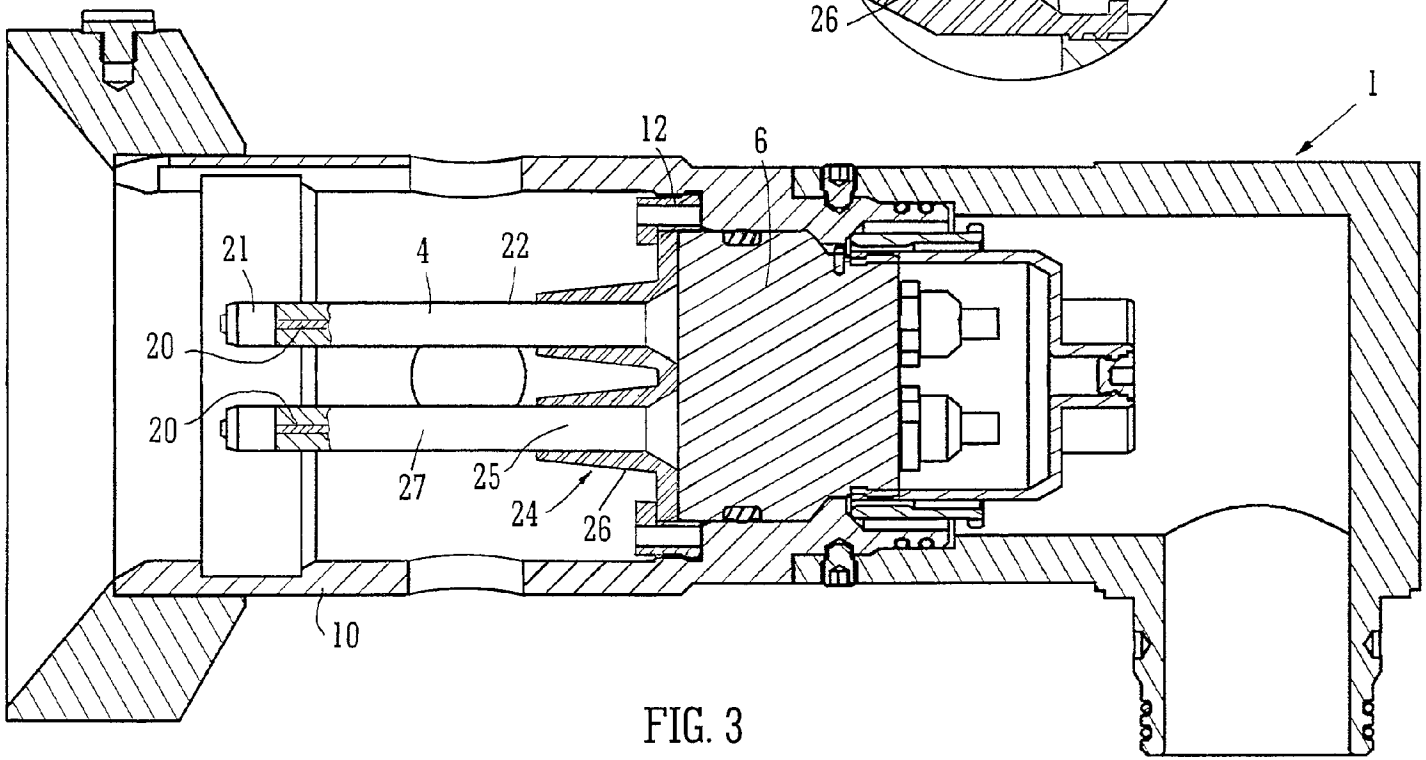
FIG. 3 shows a partly sectioned side elevation of a male part of a third embodiment of an electrical connector.

FIG. 3 shows a male connector part 1 of a connector according to a third embodiment wherein the resilient sealing means comprises an elastomeric membrane 26 extending axially a distance axially along the surface of the electrically insulating sleeve 22 in sealing engagement therewith. The elastomeric membrane 26 engages the outer surface of the insulating sleeve 22 over the full longitudinal extent of the protected portion 25 of the pin 4. The elastomeric membrane 26 is clamped under the insert locking ring 12 such that it sealingly engages the front face of the insert 6. The elastomeric membrane 26 is arranged such that it sealingly engages more than one pin 4, if provided.

Thus if any cracks develop in the protected portion 25 of the pin 4 due to bending stresses, the protective means 24, in the form of the resilient sealing means of the elastomeric membrane 26, prevents the exposure of the protected portion 25 to ambient conditions, such as seawater, and thus the use of the connector can continue without resulting in connector failure.

Figure 4:
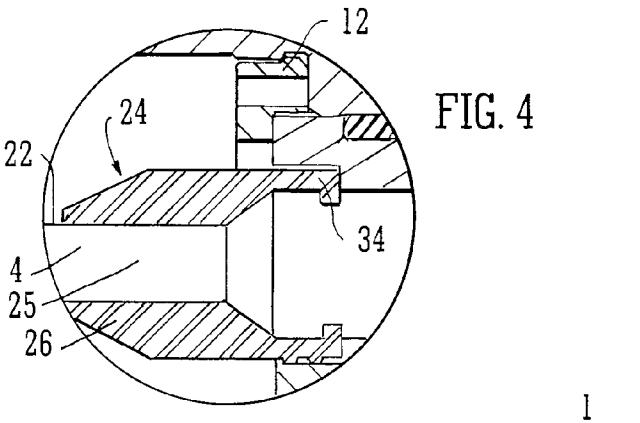
FIG. 4 shows a partly sectioned side elevation of a detail of a male part of a fourth embodiment of an electrical connector.

FIG. 4 shows a male connector part 1 of a connector according to a fourth embodiment, which is similar to the embodiment shown in FIG. 3, but the resilient sealing means comprises an elastomeric membrane 26 extending axially along the surface of the electrically insulating sleeve 22 in sealing engagement therewith a distance forwardly and rearwardly of the front face of the insert 6. The elastomeric membrane 26 engages the outer surface of the insulating portion 22 over the full longitudinal extent of the protected portion 25 of the pin 4. The portion of the elastomeric membrane 26 extending axially rearward of the front face of the insert 6 is provided in sealing engagement 34 with the insert 6 such that the protected portion 25 of the pin 4 is prevented from exposure to the ambient environment. This fourth electrical connector design provides an individual elastomeric membrane 26 seal for each pin 4. Thus, in this electrical connector design, the protective means 24 can be used for individual pins in a variety of pin arrangements.

Figures 5A, 5B:
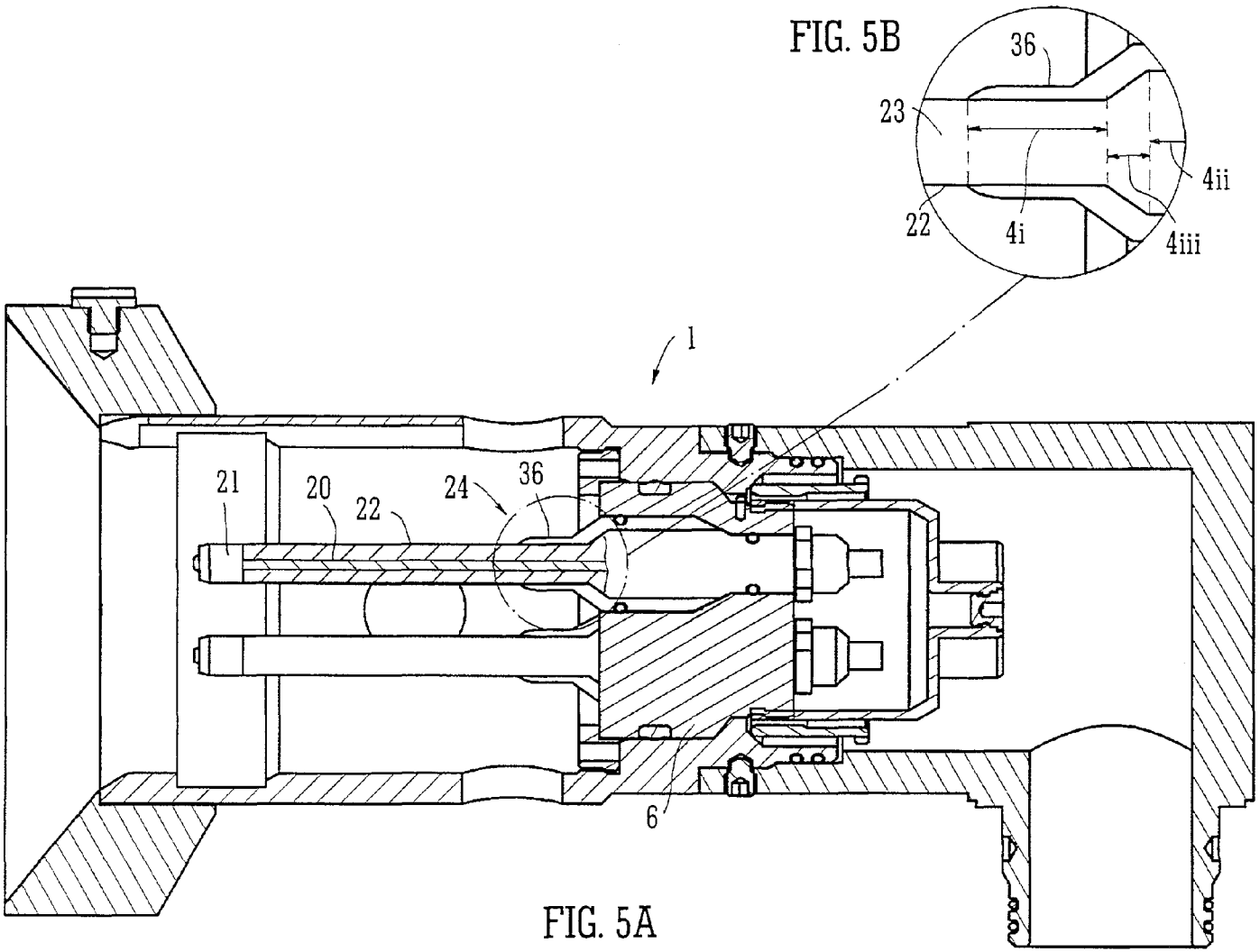
FIGS. 5A and 5B show a partly sectioned side elevation of a male part of a fifth embodiment of an electrical connector, with FIG. 5B representing a detail of the area circled in FIG. 5A.

FIGS. 5A and 5B show a male connector part 1 of a connector according to a fifth embodiment wherein the protective means 24 comprises a rigid supporting sleeve 36 which provides mechanical support to the protected portion 25 of the pin 4. The rigid supporting sleeve 36 extends axially along the surface of the electrically insulating sleeve 22 of the pin 4 a distance forwardly and rearwardly of the front face of the insert 6. The rigid supporting sleeve 36 engages the outer surface of the insulating sleeve 22 over the full longitudinal extent of the protected portion 25 of the pin 4.

The rigid supporting sleeve 36 is provided as an individual rigid supporting sleeve 36 for each pin 4A, 4B which provides a high level of protection to the pin which it surrounds. The rigid supporting sleeve 36 provides mechanical support to that pin and no others by extending in and abutting against the insert 6 and also extending along the protected portion 25 of the pin 4.

The external diameter of the insulating sleeve 22 in at least the foremost region of the protected portion 25 of the pin 4 is greater than or equal to the external diameter of the insulating sleeve 22 in the region 23 immediately forward of the protected portion 25 of the pin. In this way, no recess in the surface of insulating sleeve 22 is required as a seat for the rigid supporting sleeve 36. Instead the rigid supporting sleeve 36 is seated on the outer surface of the insulating sleeve 22 which has a diameter that does not decrease in the protected portion 25 of the pin 4, and therefore the pin 4 can be simply manufactured with no complicated moulding required and rigid supporting sleeve 36 can be put in position by merely sliding it over the pin 4.

The insulating sleeve 22 of the pin 4 has a first portion 4*i* with a first diameter in front of a second portion 4*ii* with a second diameter wider than the first diameter. A conically shaped portion 4*iii* is provided between the first portion 4*i* and the second portion. The rigid supporting sleeve 36 is arranged to extend at least partly along the first portion 4*i* of the insulating sleeve 22 and at least partly along the second portion 4*ii* thereof. The rigid supporting sleeve 36 provides mechanical support to the protected portion 25 of the pin 4. Providing the pin 4 with a rigid supporting sleeve 36 extending along the insulating sleeve 25 having a first portion 4*i* and a second portion 4*ii* of this shape and arrangement gives a pin shape and support sleeve that provides mechanical support to the protected portion 25 such that cracking of the pin due to high stress in that area is prevented. The rigid supporting sleeve 36 is preferably comprised of rigid material such as a metal or may be a polymeric component of high stiffness.

The rigid supporting sleeve 36 reinforces the protected portion 25 of the pin 4 and strengthens it against bending or shock stresses. It offers support against stresses acting on the pin by way of reactionary forces, such that the stresses will not result in the cracking of the pin.

The rigid supporting sleeve 36 is provided in sealing engagement with the electrically insulating sleeve 22 of the pin such that the protected portion 25 of the pin 4 is also prevented from exposure to the ambient environment. This can be achieved for example by insert moulding. However, even if the sleeve 36 does not form a watertight seal with the sleeve 22, it can provide mechanical reinforcement and thereby prevent or minimise cracking or the propagation of cracks. An O-ring seal is provided between the rigid supporting sleeve 36 and the support 6 to seal the interface therebetween.

The pin 4 has an axially extending conducting portion 20 (shown in partial cut-away of the pin only) surrounded by an axially extending insulating portion 22. In cross sectional profile, the pin 4 has a conically shaped section adjacent to the insert 6 and an axially cylindrical section extending forwardly from the conical section. Alternatively, the pin may have any suitable profile. The axially extending insulating portion 22 is arranged such that near the front end of the pin a conducting ring 21, electrically connected to the axially extending conducting portion 20, is exposed to make electrical contact when mated.

Figure 6A:
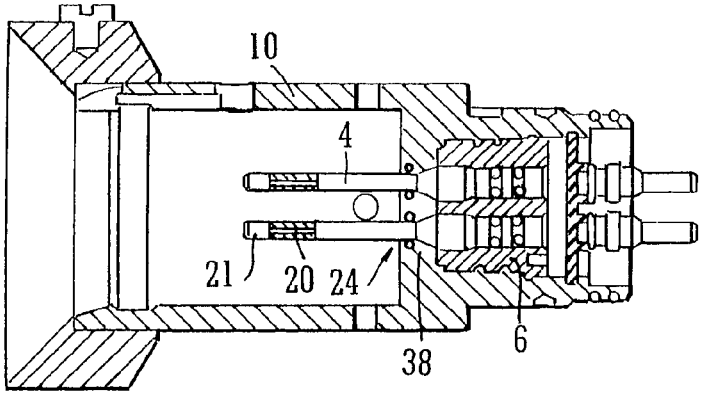
FIGS. 6A and 6B show a cross sectioned side elevation of a male part of a sixth embodiment of an electrical connector, with FIG. 6B representing a detail of the area circled in FIG. 6A.
Figure 6B:
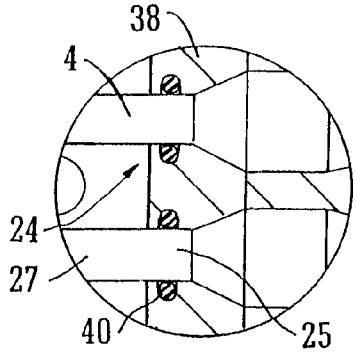

FIGS. 6A and 6B show a male connector part 1 of a connector according to a sixth embodiment, wherein the protective means 24 comprises a rigid supporting portion 38 connected to the housing 10 of the male connector part 1. The rigid supporting portion 38 surrounds the full axial extent of the protected portion 25 of the pin 4 and extends a distance radially outwardly. The rigid supporting portion 38 is an integrally formed part of the housing 10. Alternatively, the rigid supporting portion 38 may be connected to the insert 6 by being integrally formed therewith or otherwise instead of being connected to the housing 10.

The rigid supporting portion 38 reinforces the protected portion 25 of the pin 4 and strengthens it against bending or shock stresses. It offers support against stresses acting on the pin by way of reactionary forces, such that the stresses will not result in the cracking of the pin.

Resilient sealing means 40 engaging the pin 4 is provided to prevent exposure of the protected area of the pin 4 to ambient conditions. Thus, even if, despite the mechanical support, the protected portion 25 of the pin 4 is subject to cracking, the failure of the connector can be prevented. In this sixth embodiment, the resilient sealing means 40 comprises an O-ring seal engaging the pin 4 and the rigid supporting portion 38.

Figure 7:
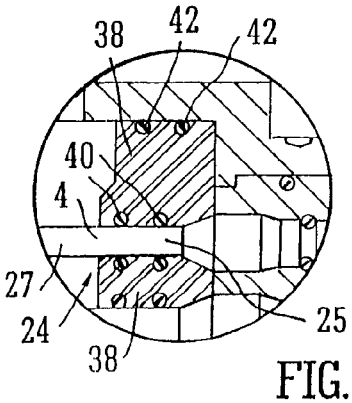
FIG. 7 shows a cross sectioned side elevation of a detail of a male part of a seventh embodiment of an electrical connector.

FIG. 7 shows a male connector part 1 of a connector according to a seventh embodiment, which is similar to the embodiment shown in FIGS. 6A and 6B, but the protective means 24 comprises a rigid supporting portion 38 which fits into the receptacle 16 to abut against the inner wall of the housing 10 and provide mechanical support to the pin 4 or pins.

The rigid supporting portion 38 reinforces the protected portion 25 of the pin 4 and strengthens it against bending or shock stresses. It offers support against stresses acting on the pin by way of reactionary forces, such that the stresses will not result in the cracking of the pin.

This abutting rigid supporting portion 38 is sealingly connected to the housing 10 by resilient outer O-ring seals 42 and resilient sealing means 40 engaging the pin may be provided in the form of O-ring seals such that the protected portion 25 of the pin 4 is prevented from exposure to the external environment.

Figure 8:
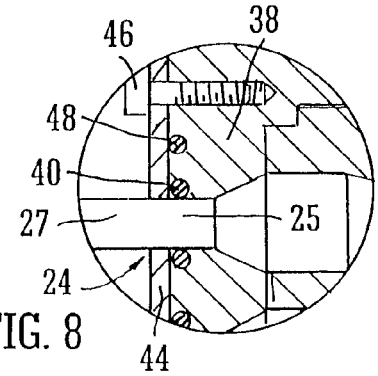
FIG. 8 shows a cross sectioned side elevation of a detail of a male part of a eighth embodiment of an electrical connector.

FIG. 8 shows a male embodiment, which is similar to the embodiment shown in FIGS. 6A and 6B and FIG. 7, but the protective means 24 comprises a rigid supporting portion 38 and a clamped front plate 44. The rigid supporting portion 38 is an integrally formed part of the housing 10. Alternatively, the rigid supporting portion 38 may fit into the receptacle 16 to abut against the inner wall of the housing 10.

The clamped front plate 44 is held in position by at least one bolt 46. A resilient face O-ring compression seal 48 engaging the rear face of the clamped front plate 44 and the front face of the rigid supporting portion 38 and resilient sealing means 40 engaging the pin may be provided to prevent the exposure of the protected portion 25 of the pin 4 to the external environment.

Thus the rigid supporting portion 38 reinforces the protected portion 25 of the pin 4 and strengthens it against bending or shock stresses. It offers support against the bending stresses acting on the pin by way of reactionary forces, such that the stresses will not result in the cracking of the pin.

It should be noted that in the embodiment described above there is no relative movement between the protective means 24 and the pin 4. That is, the protective means 24 is preferably not provided in a sliding seal arrangement. Further, the protected portion 25 of the insulating sleeve 22 may comprise a conically shaped section adjacent to the insert 6 and an axially cylindrical section extending forwardly from the conical section.

Figure 9:
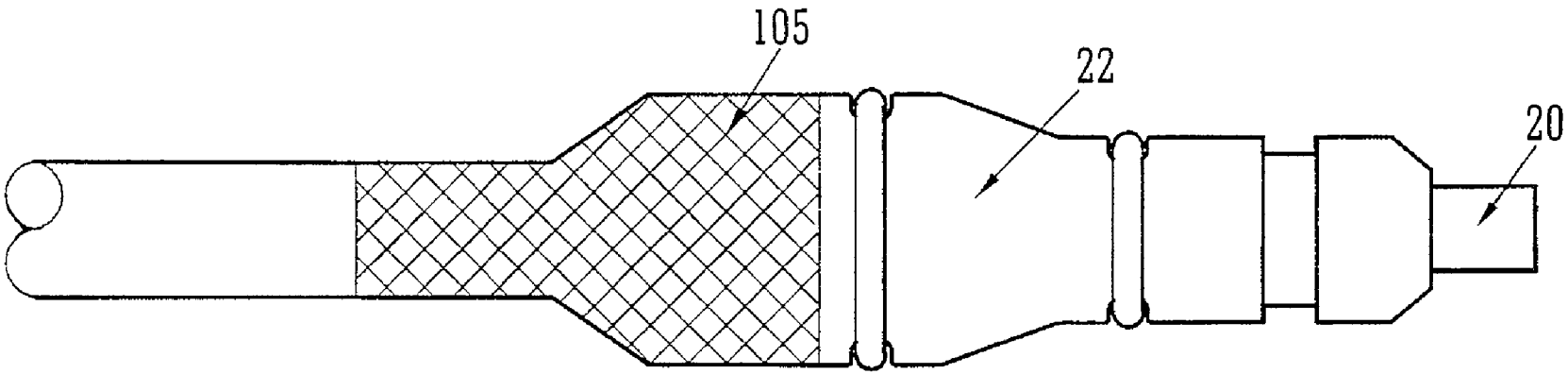
FIG. 9 shows a side view of a connector pin of a second embodiment of an electrical connector.

FIG. 9 shows a connector pin 104 of a ninth embodiment of an electrical connector. The connector pin 104 is to be mounted in an insert 6 of a connector 1 housing in the type of electrical connector shown in the designs described above and shown in FIGS. 1-8.

The insulating sleeve 22 has a metal coating 105 deposited on its surface along a length of the pin in the region where the pin extends forwardly from the insert 6 when mounted in an electrical connector 1.

The metal coating 105 has a base layer of copper 10 μm thick and a top layer of nickel also 10 μm thick.

The metal coating 105 is deposited on the surface of the insulating sleeve 22, which is form of Polyetheretherketone (PEEK), by first acid etching the surface of the PEEK in a masked off region of the part to provide a key. An activator is then applied to the surface of the PEEK to enable the deposition. The base layer and the top layer are then sequentially deposited by a suitable deposition technique, such as electroplating.

The metal coating 105 suppresses the ingress of water to the pin 4 and reduces localised condensing of equipotential electric field lines in the region radially outwardly and behind the front of the metal coating 105.

By arranging the metal coating 105 to extend along the pin 4 such that, when the connector parts are fully mated the metal coating 105 reaches to the position where it screens any seals in the second connector part from concentration of electrical field lines, electrical field stress can be reduced and the lifetime of the connector can be extended, without requiring a complicated molding or machining of the pins to include a screening electrode.

The invention claimed is:

1. A connector for use underwater or in a wet or severe environment, comprising first and second connector parts adapted to be interengaged to establish an electrical connection, the first connector part having at least one pin, and the second connector part having at least one electrical contact for engagement by the pin when the connector parts are interengaged, the pin comprising an axially extending electrically conductive portion and an axially extending electrically insulating sleeve around said conductive portion, and the pin being supported by and projecting axially forwardly from a support whereby the insulating sleeve is exposed along a longitudinally extending portion thereof to ambient conditions when the connector parts are disengaged, and the first connector part having a rigid metal protective member arranged to protect a portion of the insulating sleeve forwardly of and adjacent to the support at least when the connector parts are disengaged, the protective member extending axially along the surface of the insulating sleeve of the pin a distance forwardly and rearwardly of the front of the support, to provide mechanical support to the protected portion of the insulating sleeve, the protective member having a first axially extending cylindrical section with a first diameter, a second axially extending cylindrical section with a second diameter wider than the first diameter, the first axially extending cylindrical section being disposed in front of the second axially extending cylindrical section, and the protective member having a conically shaped section extending between the first axially extending cylindrical section and the second axially extending cylindrical section.

2. A connector as claimed in claim 1, wherein the conically shaped section is provided adjacent to the support.

3. A connector as claimed in claim 1, wherein the conically shaped section is provided adjacent to the support and extends forwardly therefrom.

4. A connector as claimed in claim 1, wherein the protective member provides mechanical support to the said pin and no others by extending in and abutting against the support and also extending along the protected portion of the insulating sleeve of the pin.

5. A connector as claimed in claim 1, wherein an O-ring seal is provided between the protective member and the support to seal the interface therebetween.

* * * * *